US009260263B2

(12) United States Patent
Yeo et al.

(10) Patent No.: US 9,260,263 B2
(45) Date of Patent: Feb. 16, 2016

(54) SUBSTRATE ALIGNING UNIT, SUBSTRATE PROCESSING APPARATUS HAVING THE SAME, AND METHOD OF ALIGNING SUBSTRATE USING THE SAME

(75) Inventors: Kyeong-Min Yeo, Hwaseong-si (KR); Min-Uk Kim, Seongnam-si (KR); Hyun-Seok Kim, Anyang-si (KR); Sin Kwon, Suwon-si (KR); Jae-Hyuk Chang, Seongnam-si (KR); Sung-Hee Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 375 days.

(21) Appl. No.: 13/558,164

(22) Filed: Jul. 25, 2012

(65) Prior Publication Data

US 2013/0126578 A1 May 23, 2013

(30) Foreign Application Priority Data

Nov. 18, 2011 (KR) ..... 10-2011-0120772

(51) Int. Cl.

| | |
|---|---|
| ***B65H 23/038*** | (2006.01) |
| ***B65H 23/192*** | (2006.01) |
| ***B65H 18/10*** | (2006.01) |
| ***B65H 23/188*** | (2006.01) |

(52) U.S. Cl.

CPC ..... *B65H 18/103* (2013.01); *B65H 23/038* (2013.01); *B65H 23/1882* (2013.01); *B65H 23/192* (2013.01); *B65H 2301/3613* (2013.01); *B65H 2513/11* (2013.01); *B65H 2553/51* (2013.01); *B65H 2553/512* (2013.01)

(58) Field of Classification Search

CPC ..... B65H 23/0204; B65H 23/038; B65H 23/188; B65H 23/1882; B65H 23/1888; B65H 23/192; B65H 2301/3613; B65H 2513/11; B65H 2553/51; B65H 2553/512; B65H 2404/53; B65H 2404/531

USPC ..... 226/2, 3, 15, 16, 18, 19, 20, 24, 27, 28, 226/29, 30, 31, 45

See application file for complete search history.

(56) References Cited

U.S. PATENT DOCUMENTS

| | | | | |
|---|---|---|---|---|
| 4,190,475 | A * | 2/1980 | Marschke | 156/157 |
| 4,485,982 | A * | 12/1984 | St. John et al. | 242/563.1 |
| 5,043,904 | A * | 8/1991 | Sikes et al. | 700/125 |
| 5,098,507 | A * | 3/1992 | Mao | 156/351 |
| 2003/0213867 | A1* | 11/2003 | Yomeoka | 242/615.1 |
| 2010/0072245 | A1 | 3/2010 | Kim et al. | |
| 2010/0108733 | A1* | 5/2010 | Fuwa | 226/1 |
| 2010/0209162 | A1 | 8/2010 | Ferrara et al. | |

FOREIGN PATENT DOCUMENTS

| | | |
|---|---|---|
| JP | 3192640 | 7/2001 |
| JP | 2007-165452 | 6/2007 |

(Continued)

*Primary Examiner* — William E Dondero

(74) *Attorney, Agent, or Firm* — H.C. Park & Associates, PLC

(57) ABSTRACT

A substrate aligning unit includes a first driving roll, a second driving roll, a web guider, an encoder roll, and a controller. The first driving roll transfers a substrate in a first direction. The second driving roll is disposed spaced apart from the first driving roll in the first direction and transfers the substrate in the first direction. The web guider controls a position of the substrate in a second direction substantially perpendicular to the first direction. The encoder roll senses the position of the substrate to generate a sensing signal. The controller controls the first driving roll, the second driving roll, and the web guider based on the sensing signal.

16 Claims, 6 Drawing Sheets

(56) References Cited

FOREIGN PATENT DOCUMENTS

| | | |
|---|---|---|
| JP | 2010-522828 | 7/2010 |
| JP | 2011-032555 | 2/2011 |
| KR | 1020060118912 | 11/2006 |
| KR | 1020100006088 | 1/2010 |
| KR | 10-0975565 | 8/2010 |
| KR | 10-1002188 | 12/2010 |
| KR | 101005584 | 1/2011 |

* cited by examiner

SUBSTRATE ALIGNING UNIT, SUBSTRATE PROCESSING APPARATUS HAVING THE SAME, AND METHOD OF ALIGNING SUBSTRATE USING THE SAME

CROSS-REFERENCE TO RELATED APPLICATION

This application claims priority from and the benefit or Korean Patent Application No. 10-2011-0120772, filed on Nov. 18, 2011, which is hereby incorporated by reference for all purposes as if fully set forth herein.

BACKGROUND OF THE INVENTION

1. Field of the Invention

Exemplary embodiments of the invention relate to a substrate aligning unit capable of precisely controlling a position of a substrate being transferred, a substrate processing apparatus having the same, and a method of aligning a substrate using the same.

2. Discussion of the Background

A flexible display apparatus having a light weight, strong durability, and competitive pricing has been developed. A roll-to-roll process may be used in a manufacturing process of the flexible display apparatus. According to the roll-to-roll process, a thin substrate is continuously transported from a supplying roll to a receiving roll. However, several problems in the manufacturing process of a display panel of the flexible display apparatus still need to be addressed. For instance, issues related to alignment control, speed control, and position control of the substrate may lead to defects in the manufactured substrate or substrate slips during the manufacturing process. Thus, an improved manufacturing process is needed to provide better substrates with a greater efficiency.

To solve the above-mentioned problems, openings may be formed through a portion of the substrate, and protrusions may be formed on the surface of the driving roll. However, additional work is necessary for forming the openings and the protrusions. In addition, a usable area of the substrate is decreased due to the openings. Accordingly, other solutions are needed to address the above-noted problems.

SUMMARY OF THE INVENTION

Exemplary embodiments of the invention provide a substrate aligning unit capable of precisely controlling a position of a substrate being transferred.

Exemplary embodiments of the invention also provide a substrate processing apparatus having the substrate aligning unit.

Exemplary embodiments of the invention also provide a method of aligning a substrate using the substrate aligning unit.

Additional features of the invention will be set forth in the description which follows, and in part will be apparent from the description, or may be learned by practice of the invention.

Exemplary embodiments of the invention disclose a substrate aligning unit including a first driving roll, a second driving roll, a web guider, an encoder roll, and a controller. The first driving roll is configured to transfer a substrate. The second driving roll is spaced apart from the first driving roll and is configured to transfer the substrate. The encoder roll determines a position of the substrate to generate a sensing signal. The web guider is configured to guide the substrate from the first driving roll to the encoder roll. The controller controls the first driving roll, the second driving roll, and the web guider based on the sensing signal. The web guider is configured to change a direction of the substrate.

Exemplary embodiments of the invention also disclose a substrate processing apparatus including a substrate aligning unit and a processing part. The processing part is coupled to the substrate aligning unit and processes the substrate. The substrate aligning unit includes a first driving roll, a second driving roll, a web guider, an encoder roll, and a controller. The first driving roll transfers a substrate in a first direction. The second driving roll is spaced apart from the first driving roll and is configured to transfer the substrate in the first direction. The web guider guides the substrate in a second direction different than the first direction. The encoder roll detects the position of the substrate to generate a sensing signal. The controller controls the first driving roll, the second driving roll, and the web guider based on the sensing signal.

Exemplary embodiments of the invention also disclose a method of aligning a substrate. The method includes determining a position of the substrate using an encoder roll to generate a sensing signal according to the determined position, and controlling a first driving roll and a second driving roll to transfer a substrate, and controlling a web guider to guide the substrate and to change a direction of the substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF ILLUSTRATED EMBODIMENTS

Figure 1:
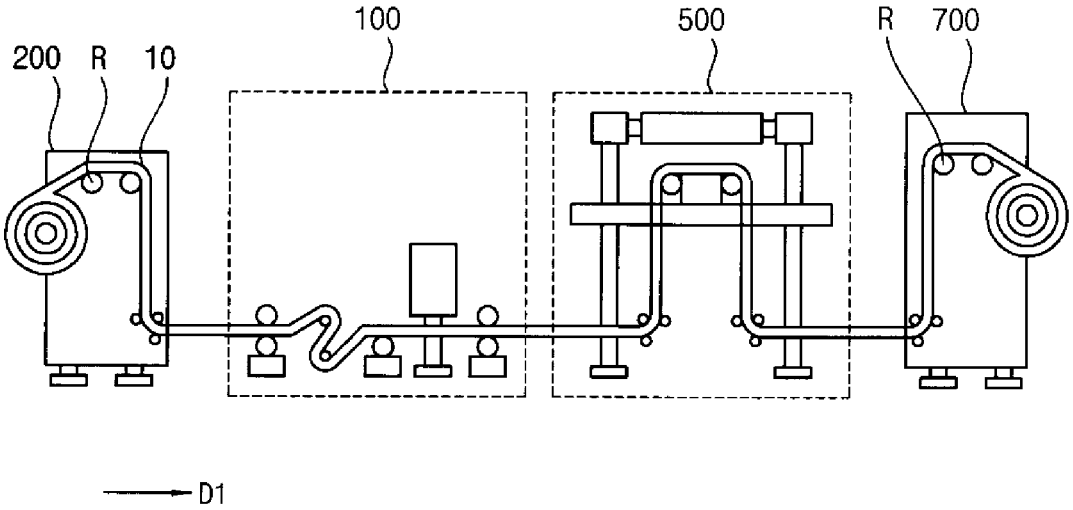
FIG. 1 is a side view illustrating a substrate processing apparatus according to exemplary embodiments of the invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It may also be understood that for the purposes of this disclosure, "at least one of X, Y, and Z" can be construed as X only, Y only, Z only, or any combination of two or more items X, Y, and Z (e.g., XYZ, XYY, YZ, ZZ).

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing exemplary embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, is for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Hereinafter, exemplary embodiments of the invention will be explained in detail with reference to the accompanying drawings.

FIG. 1 is a side view illustrating a substrate processing apparatus according to exemplary embodiments of the invention.

Referring to FIG. 1, the substrate processing apparatus may include a supplying part 200, a substrate aligning unit 100, a processing part 500, and a receiving part 700.

The supplying part 200 may include a supplying roll supplying a substrate 10 to the substrate aligning unit 100. The supplying part 200 may include at least one transfer roll R for supplying the substrate 10 to the substrate aligning unit 100.

The substrate 10 may be a flexible substrate. Examples of the substrate 10 include a plastic substrate, a metal foil, and a thin glass substrate. For example, the substrate 10 may include polycarbonate (PC) or polyethylene terephthalate (PET).

A radius of the transfer roll R may be set as required. In some cases, more than one transfer roll may be used, and all the transfer rolls R may have the same radius. In some cases, the radii of the transfer rolls R may vary according to a position and/or a function of the transfer rolls R.

The substrate aligning unit 100 may be adjacent to the supplying part 200 to receive the substrate from the supplying part 200. The substrate aligning unit 100 will be explained, hereinafter. Although the substrate aligning unit 100 is described as being adjacent to the supplying part 200, the substrate aligning unit 100 may be positioned at various suitable locations/positions. In addition, one or more of the substrate aligning units 100 may be used for aligning the substrate 10.

The processing part 500 may be adjacent to the substrate aligning unit 100 to receive the substrate 10 from the substrate aligning unit 100. One or more processes, such as a patterning process and/or a drying process, may be performed on the substrate 10 in the processing part 500. One or more processing parts 500 may be used and may be configured according to various suitable means. For example, a patterning processing part for performing a patterning process and a drying processing part for performing a drying process may be used. The drying processing part may be connected to the output of the patterning processing part to dry the patterned substrate provided from the patterning processing unit.

The receiving part 700 may be adjacent to the processing part 500 to receive the substrate 10 from the processing part 500.

The receiving part 700 may include a receiving roll that receives the substrate 10. The receiving part 700 may include at least one transfer roll R to receive the substrate 10.

The substrate 10 may be transferred through the supplying part 200, the substrate aligning unit 100, the processing part 500, and the receiving part 700 in a first direction D1.

Figure 2:
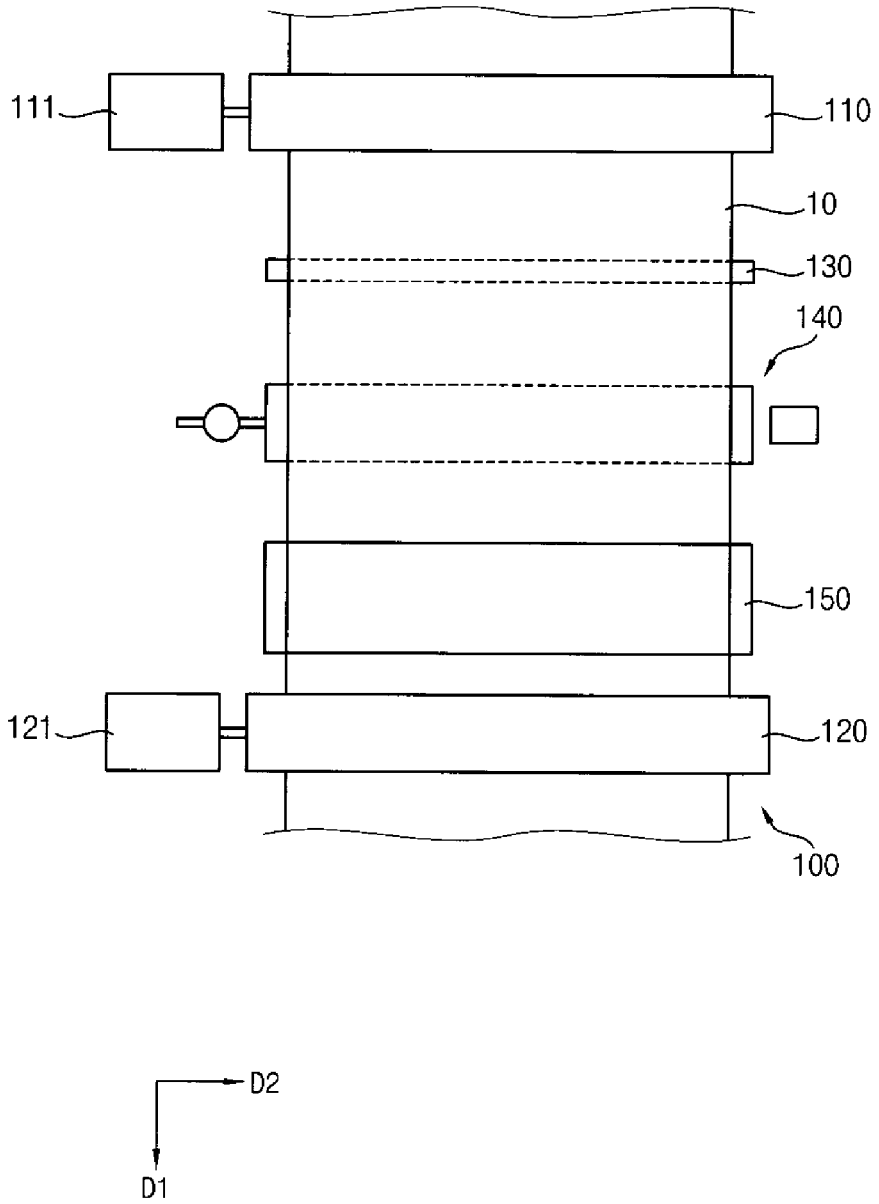
FIG. 2 is a plan view illustrating a substrate aligning unit of FIG. 1 according to exemplary embodiments of the invention.
Figure 3:
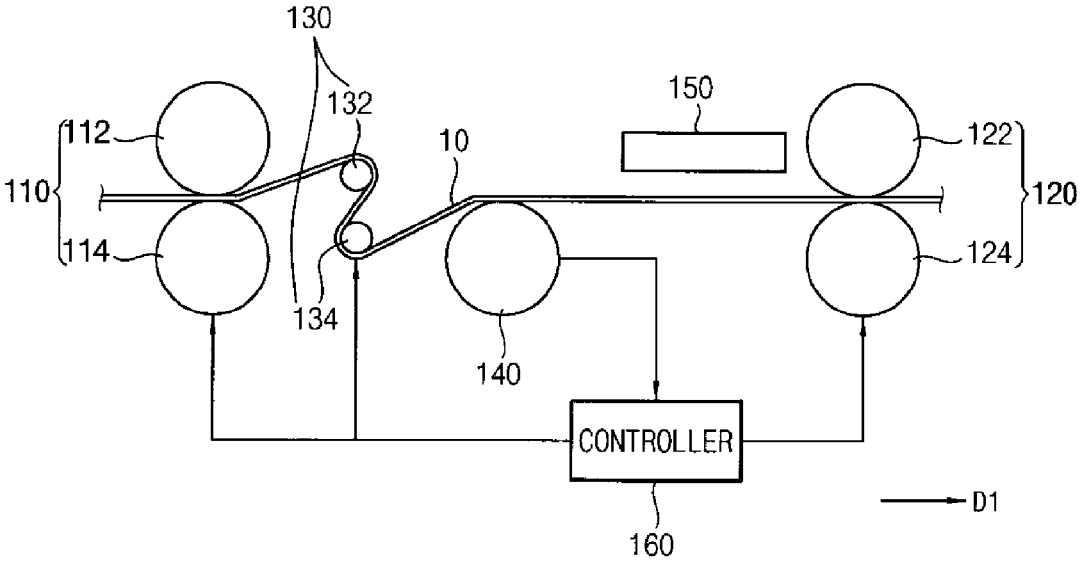
FIG. 3 is a side view illustrating the substrate aligning unit of FIG. 2 according to exemplary embodiments of the invention.

FIG. 2 is a plan view illustrating a substrate aligning unit 100 of FIG. 1. FIG. 3 is a side view illustrating the substrate aligning unit 100 of FIG. 2.

Referring to FIG. 2 and FIG. 3, a substrate aligning unit 100 may include a first is driving roll 110, a second driving roll 120, a web guider 130, an encoder roll 140, a precise aligning part 150, and a controller 160.

The first driving roll 110 may transfer the substrate 10 in a first direction D1. The second driving roll 120 is spaced apart from the first driving roll 110 in a first direction, and may further transfer the substrate 10 in the first direction D1.

The first driving roll 110 may include a first upper driving roll 112 and a first lower driving roll 114. The first upper driving roll 112 may be positioned above the first lower driving roll 114. The substrate 10 may be supplied between the first upper driving roll 112 and the first lower driving roll 114. The first upper driving roll 112 and the lower driving roll 114 may rotate when contacting the substrate 10, so that the substrate 10 may be transferred. A first driving motor 111 may be connected to the first driving roll 110 to drive the first driving roll 110. The first upper driving roll 112 and the first lower driving roll 114 may be driven in directions different from each other, so that the substrate 10 may be transferred. For example, the first upper driving roll 112 may be driven counter-clockwise, and the first lower driving roll 114 may be driven clockwise. In general, various suitable motors may be used as the first driving motor 111.

The second driving roll 120 may include a second upper driving roll 122 and a second lower driving roll 124. The second upper driving roll 122 may be positioned above the second lower driving roll 124. The substrate 10 may be supplied between the second upper driving roll 122 and the second lower driving roll 124. The second upper driving roll 122 and the lower driving roll 124 may rotate when contacting the substrate 10, so that the substrate 10 may be transferred. A second driving motor 121 may be connected to the second driving roll 120 to drive the second driving roll 120. The second upper driving roll 122 and the second lower is driving roll 124 may be driven in directions different from each other, so that the substrate 10 may be transferred. For example, the second upper driving roll 122 may be driven counterclockwise, and the second lower driving roll 124 may be driven clockwise. In general, various suitable motors may be used as the second driving motor 121.

The web guider 130 is provided between the first driving roll 110 and the second driving roll 120. The web guider 130 may adjust a position of the substrate 10 in a second direction D2, which may be different (e.g., substantially perpendicular) to the first direction D1 in which the substrate 10 is transferred. The second direction D2 may be a CMD (cross machine direction). The web guider 130 may include a first web guider roll 132 and a second web guider roll 134. The second web guider roll 134 may be parallel to and provided below the first web guider roll 132. The substrate 10 may be transferred from the first web guider roll 132 to the second web guider roll 134. Positions of the first web guider roll 132 and the second web guider roll 134 may be changed to adjust the position of the substrate 10 in the second direction D2. For example, after passing the first web guider roll 132, the substrate 10 may move in the second direction D2, and after passing the second web guider roll 134, the substrate 10 may move in substantially the first direction D1. Thus, the web guider 130 may adjust the position and direction of the substrate 10. For example, the first web guider roll 132 and the second web guider roll 134 may be disposed in parallel with the first direction.

Although the first web guider roll 132 is provided above the second web guider roll 134, the web guider 130 may have various configurations to move the substrate 10 in any suitable direction.

The encoder roll 140 may be situated between the first driving roll 110 and the second driving roll 120, and may contact the substrate 10 provided from the second web guider is roll 134. The position of the substrate 10 may be measured using the encoder roll 140.

The precise aligning part 150 may be situated between the first driving roll 110 and the second driving roll 120. The precise aligning part 150 precisely aligns the substrate 10 for further processing of the substrate 10.

For example, the precise aligning part 150 may include one or more stages, a camera part, a comparing part, and a precise controller (not shown). An aligning mark may be formed on the substrate 10. Various types of aligning marks may be used. The aligning mark may be a letter or a symbol that provides information about a manufacturer or manufacturing process. Examples of the aligning mark may include a serial number and a circuit pattern. The camera part is positioned such that the camera part may take a photograph of the aligning mark. The comparing part receives information about the aligning mark using the photograph of the aligning mark, and compares the information with a reference mark for aligning the substrate 10. The precise controller may then adjust or align the position of the substrate 10, if necessary, to coincide the aligning mark with the reference mark. Although the precise aligning part 150 is described as including one or more stages, the camera part, the comparing part, and the precise controller, exemplary embodiments of the invention are not limited thereto and various suitable precise aligning parts may be used.

The controller 160 may control the first driving roll 110, the second driving roll 120, the encoder roll 140, and the web guider 130. The controller 160 may receive a sensing signal having information about the position of the substrate 10 from the encoder roll 140. The controller 160 may calculate a difference between an expected amount of transfer and an actual amount of transfer in response to the sensing signal. The expected amount of transfer may be determined by a manufacturer or user settings. The controller 160 may generate a correction is signal and output the correction signal to the first driving roll 110, the second driving roll 120, and the web guider 130. The controller 160 may control the first driving roll 110, the second driving roll 120, and the web guider 130 based on the correction signal. Thus, the first driving roll 110, the second driving roll 120, and the web guider 130 may increase, decrease, or maintain the rate of transfer of the substrate 10 according to the correction signal. These steps may be repeated. Thus, the substrate 10 may be precisely transferred by feedback. Precise transfer of the substrate 10 may also decrease problems in detecting the aligning mark. In some cases, the encoder roll 140 may provide the sensing signal to the controller 160 periodically according to a predetermined period. In some cases, the encoder roll 140 may provide the sensing signal to the controller 160 upon a request from the controller 160. The request from the controller 160 may be sent to the encoder roll 140 in response to an input received by the controller 160 from a user or manufacturer.

Figure 4:
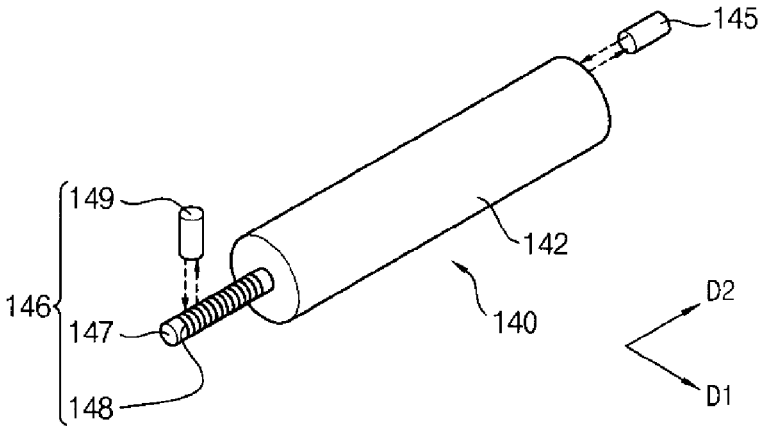
FIG. 4 is a perspective view of an encoder roll of the substrate aligning unit of FIG. 2 according to exemplary embodiments of the invention.
Figure 5:
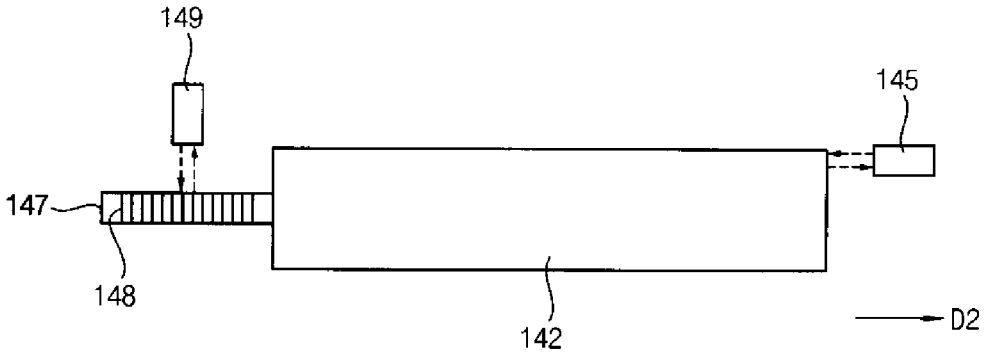
FIG. 5 is a front view of the encoder roll of FIG. 4 according to exemplary embodiments of the invention.
Figure 6:
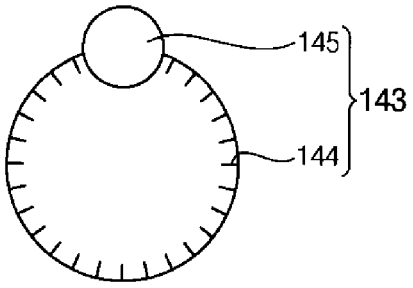
FIG. 6 is a side view of a first encoder of the encoder roll of FIG. 4 according to exemplary embodiments of the invention.

FIG. 4 is a perspective view of an encoder roll 140 of the substrate aligning unit 100 of FIG. 2. FIG. 5 is a front view of the encoder roll 140 of FIG. 4. FIG. 6 is a side view of a first encoder 143 of the encoder roll 140 of FIG. 4.

Referring to FIG. 4, FIG. 5, and FIG. 6, the encoder roll 140 includes a body 142, a first encoder 143, and a second encoder 146.

In some cases, the body 142 may have a cylindrical shape. In general, the body 142 may have various suitable shapes. The body 142 may be provided such that the substrate 10 contacts the body 142 and the body 142 may be rotated as the substrate 10 is transferred in the first direction D1. The body 142 may be provided so that the substrate 10 rolls on top of the body 142. A surface of the body 142 may include a material having a relatively high frictional coefficient. For example, the surface of the body 142 may be coated with polydimethylsiloxane is or urethane.

The first encoder 143 includes a first scale 144 and a first encoder head 145.

The first scale 144 may be formed along a circular arc of a first end of the body 142. The first scale 144 may be a groove of a metal film. The first encoder head 145 may be attached to the first scale 144. The first encoder head 145 may emit light onto the first scale 144, and may detect light reflected from the first scale 144. Light reflected from the first scale 144 may indicate that the encoder roll 140 is moving in the first direction D1, and therefore the first encoder head 145 may sense a movement of the first scale 144 in the first direction D1. The amount of substrate 10 that has been transferred in the first direction D1 may be determined according to an amount of rotation of the first scale 144. Thus, the first encoder head 145 may also determine the rotation amount of the encoder roll 140 in the first direction D1 using the first scale 144, and may generates a first sensing signal having information (e.g., movement, position) of the substrate 10 in the first direction D1.

The second encoder 146 includes a protrusion 147, a second scale 148, and a second encoder head 149.

The protrusion 147 may be attached to or integrated, at least partially, into a side of the body 142. For example, the protrusion 147 may be disposed at a second end opposite to the first end. The protrusion 147 may extend along an axis of rotation of the body 142. The second scale 148 may be formed on the protrusion 147. The second scale 148 may be a groove of a metal film. The second encoder head 149 may be attached to or integrated, at least partially, into the second scale 148. The second encoder head 149 may emit light onto the second scale 148, and may detect light reflected from the second scale 148. Light reflected from the first scale 144 may indicate that the encoder roll 140 is moving in the second direction D2, and therefore, the second encoder head 149 may sense a movement of the second scale 148 in the second direction D2. The second encoder head 149 may determine an amount of movement of the encoder roll 140 in the second direction D2 using the second scale 148, and may generate a second sensing signal having an information (e.g., movement, position) about the substrate 10 in the second direction D2.

The controller 160 may generate a correction signal based on the first and second sensing signals as a feedback mechanism. The controller 160 may receive the first and second sensing signals having information about position of the substrate 10 and the amount of substrate 10 transferred from the encoder roll 140. The controller 160 may calculate a difference between an actual transferring distance and an expected transferring distance in response to the first and second sensing signals, and may transmit the correction signal to the first driving roll 110, the second driving roll 120, and the web guider 130. Accordingly, the first driving roll 110, the second driving roll 120, and the web guider 130 may adjust or maintain transfer of the substrate 10 in response to the correction signal. For example, the controller 160 may generate a first correction signal correcting the position of the substrate 10 in the first direction D1 based on the first sensing signal, and may control the first driving roll 110 and the second driving roll 120. The controller 160 may generate a second correction signal correcting the position of the substrate 10 in the second direction D2 based on the second sensing signal, and may control the web guider 130.

Figure 7:
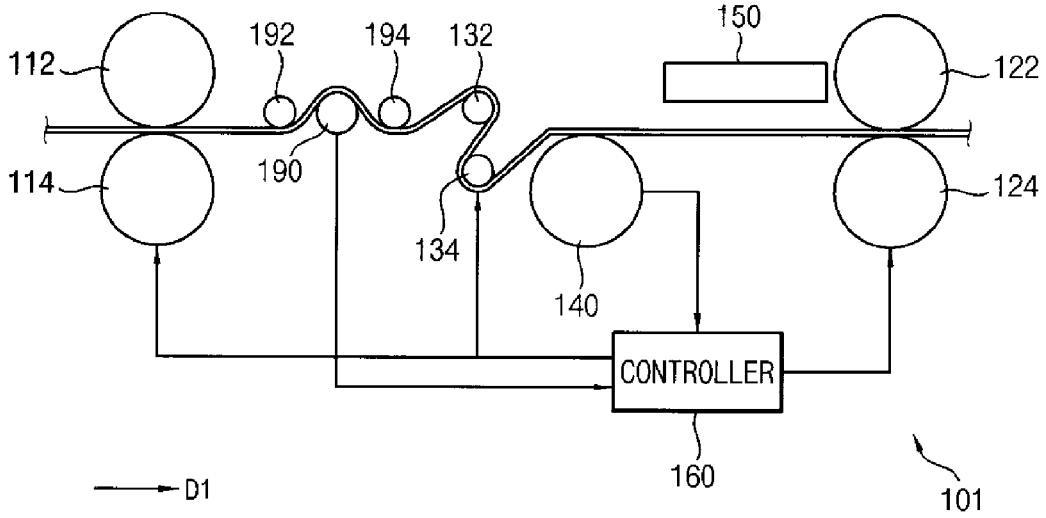
FIG. 7 is a side view illustrating a substrate aligning unit according to exemplary embodiments of the invention.

FIG. 7 is a side view illustrating a substrate aligning unit according to exemplary embodiments of the invention.

Referring to FIG. 7, the substrate aligning unit 101 may be substantially same as the substrate aligning unit 100 described in FIG. 1, FIG. 2, FIG. 3, FIG. 4, FIG. 5, and FIG. 6 is except that the substrate aligning unit 101 may further include a tension sensing roll 190 and first and second auxiliary rollers 192 and 194, and that the controller 160 further controls a tension of a substrate 10. Any further repetitive explanation concerning the above elements will be omitted.

The tension sensing roll 190 may be provided adjacent to the first driving roll 110, and may contact the substrate 10. In some cases, the tension sensing roll 190 may have a cylindrical shape. In general, the tension sensing roll 190 may have various suitable shapes. The first and second auxiliary rollers 192 and 194 are disposed at opposite sides, respectively, of the tension sensing roll 190 with reference to the substrate 10. The substrate 10 may be transferred below the first auxiliary roller 192, above the tension sensing roll 190, and below the second auxiliary roller 194, or vice-versa. Accordingly, the substrate 10 may contact a bottom side of the first auxiliary roller 192, a top side of the tension sensing roll 190, and a bottom side of the second auxiliary roller 194, or vice-versa. The first and second auxiliary rollers 192 and 194 may depress the substrate 10 in such a manner that the tension sensing roll 190 may effectively sense a tension of the substrate 10.

The tension sensing roll 190 may sense the tension of the substrate 10, and generate a tension signal. The controller 160 may receive the tension signal, and generate a tension correction signal to make the tension of the substrate 10 constant in response to receiving the tension signal. First and second driving motors 111 and 121, respectively, connected to the first driving roll 100 and the second driving roll 120 are controlled based on the tension correction signal controls. For example, when the tension of the substrate 10 is larger than a predetermined tension, a rotation speed of the first driving roll 110 may be controlled to be faster than the rotation speed of the second driving roll 120, so that the tension of the substrate 10 may is be decreased. In some cases, when the tension of the substrate 10 is smaller than the predetermined tension, the rotation speed of the first driving roll 110 may be controlled to be slower than the rotation speed of the second driving roll 120, so that the tension of the substrate 10 may be increased. Thus, the tension of the substrate 10 may be maintained at a constant tension. The predetermined tension may be set according to a designer's or user's specification.

Figure 8:
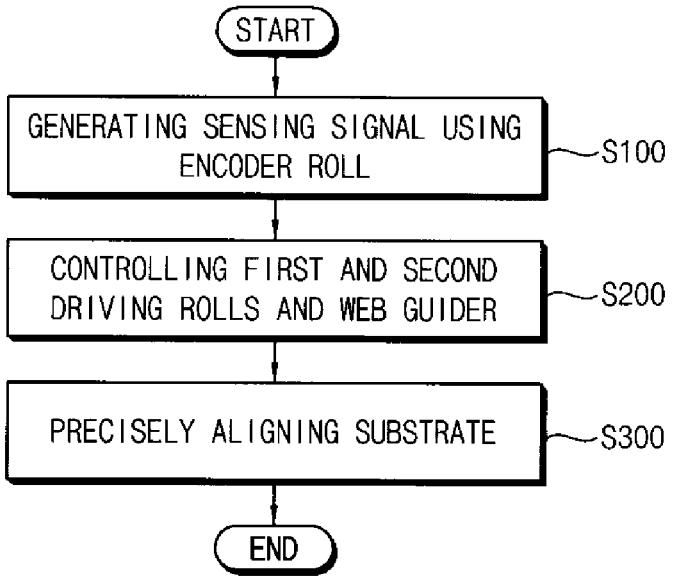
FIG. 8 is a flow chart illustrating a method of aligning a substrate according to exemplary embodiments of the invention.
Figure 9:
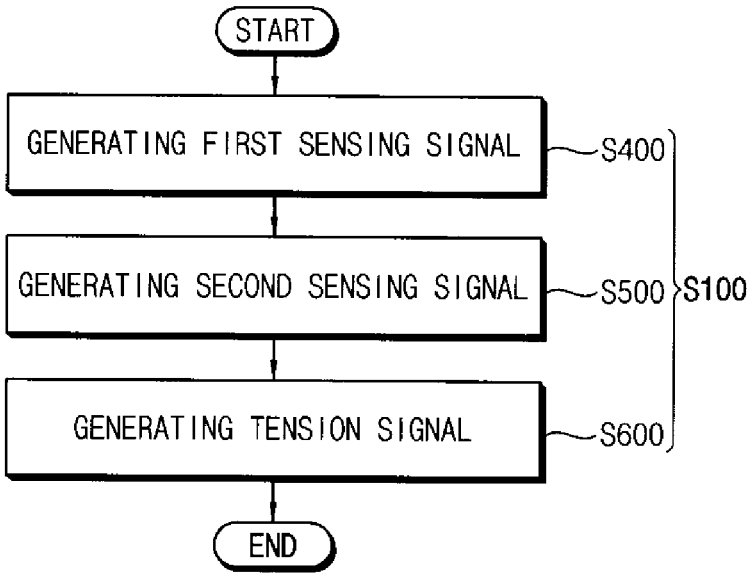
FIG. 9 is a flow chart illustrating a step for generating a sensing signal the using encoder roll according to exemplary embodiments of the invention.

FIG. 8 is a flow chart illustrating a method of aligning a substrate according to exemplary embodiments of the invention. FIG. 9 is a flow chart illustrating a method of generating a tension signal.

Referring to FIG. 8 and FIG. 9, the method of aligning the substrate 10 includes generating a sensing signal using an encoder roll 140 (S100), controlling the first driving roll 110, the second driving roll 120, and the web guider 130 (S200), and precisely aligning the substrate 10 (S300).

In the step of generating the sensing signal using the encoder roll 140 (S100), a position of the substrate 10 is sensed using the encoder roll 140 to generate a sensing signal. Generating the sensing signal using the encoder roll (S100) may include generating a first sensing signal (S400), generating a second sensing signal (S500), and generating a tension signal (S600).

In the step of generating the first sensing signal (S400), a position of the substrate 10 in a first direction D1 is sensed to generate a first sensing signal. The first direction D1 is a direction in which the substrate 10 is transferred. The first encoder 143 described in FIG. 4, FIG. 5, and FIG. 6 may be used to generate the first sensing signal. Any further repetitive explanation concerning the above elements will be omitted.

In the step of generating the second sensing signal (S500), a position of the is substrate 10 in a second direction D2 is sensed to generate a second sensing signal. The second encoder 146 described in FIG. 4, FIG. 5, and FIG. 6 may be used to generate the second sensing signal. Any further repetitive explanation concerning the above elements will be omitted.

In the step of generating a tension signal (S600), a tension of the substrate 10 is sensed to generate a tension signal. The tension sensing roll 190 may be used to generate the tension signal. Any further repetitive explanation concerning the above elements will be omitted.

In the step of controlling the first driving roll 110, the second driving roll 120, and the web guider 130 (S200), a position correction signal to correct alignment of the substrate 10 is generated based on the first and second sensing signals. In addition, a tension correction signal is generated in response to the tension signal. The first driving roll 110, the second driving roll 120, and the web guider 130 may adjust a position of the substrate 10 to a desired position based on the tension correction signal. The desired position may be a position needed to correct the alignment or transfer of the substrate 10, or to safely process the substrate 10 without error. In addition, the rotation speeds of the first driving roll 110 and the second driving roll 120 are controlled based on the tension correction signal. The controller 160 described in FIG. 6 may perform the step (S200). Any further repetitive explanation concerning the above elements will be omitted.

In the step of precisely aligning the substrate 10 (S300), an aligning mark is detected, and the substrate 10 may be precisely controlled to align the aligning mark with a reference mark for precisely aligning the substrate 10. The substrate aligning unit 100 described in FIG. 2 and FIG. 3 may be used to precisely align the substrate 10. Any further repetitive explanation concerning the above elements will be omitted.

Generating the sensing signal using the encoder roll 140 (S100), controlling the first driving roll 110 and the second driving roll 120, and the web guider 130 (S200), and precisely aligning the substrate 10 (S300) may be repeatedly and/or periodically performed to continuously correct the position of the substrate 10, so that precise transfer and alignment of the substrate 10 is possible.

According to the exemplary embodiments of the present invention, a substrate aligning unit, a substrate processing apparatus having the substrate aligning unit, and a method of aligning a substrate using the substrate aligning unit may precisely control a transfer of the substrate.

In addition, an aligning mark is accurately detected in a precise aligning part, so that the process time for the substrate may be decreased.

In addition, the position of the substrate is continuously controlled by a feedback system, so that the probability of damage to the substrate caused by a slip of the substrate may decrease.

In addition, when the substrate is a component of a display substrate, production and display quality of the display substrate may improve, and a manufacturing cost of a display substrate may decrease.

The foregoing is illustrative of the exemplary embodiments of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention.

What is claimed is:

1. A substrate aligning unit, comprising:

a first driving roll to transfer a substrate in a first direction;

a second driving roll spaced apart from the first driving roll and configured to transfer the substrate in the first direction;

an encoder roll to determine a position of the substrate to generate a sensing signal;

a web guider to guide the substrate from the first driving roll to the encoder roll, the web guider comprising a first web guider roll and a second web guider roll configured to adjust the position of the substrate in a cross machine direction parallel to a rotational axis of the encoder roll; and a controller to control the first driving roll, the second driving roll, and the web guider based on the sensing signal, wherein the encoder roll comprises:

a body;

a first encoder to determine a first position of the substrate in the cross machine direction to generate a first sensing signal, the first encoder comprising:

a first scale that moves corresponding to a movement of the substrate in the cross machine direction; and a first encoder head configured to detect a movement of the first scale and to generate the first sensing signal, wherein the first scale is formed on a protrusion disposed at a first end of the body, and the first encoder head is positioned to sense the first scale.

2. The substrate aligning unit of claim 1, wherein the web guider is configured to adjust the position of the substrate in the cross machine direction by adjusting positions of the first and second web guider rolls, and wherein the encoder roll further comprises:

a second encoder to determine a second position of the substrate in the first direction to generate a second sensing signal.

3. The substrate aligning unit of claim 2, wherein the controller generates a first position correction signal based on the first sensing signal to control the first driving roll and the second driving roll to correct the first position of the substrate in the cross machine direction, and generates a second position correction signal based on the second sensing signal to control the web guider to correct the second position of the substrate in the first direction.

4. The substrate aligning unit of claim 2, further comprising a coating disposed on a surface of the encoder roll, the coating comprising polydimethylsiloxane, urethane, or both polydimethylsiloxane and urethane.

5. The substrate aligning unit of claim 2, wherein the second encoder comprises:

a second scale that moves corresponding to a movement of the substrate in the first direction; and a second encoder head configured to detect a movement of the second scale and to generate the second sensing signal corresponding to the movement of the second scale.

6. The substrate aligning unit of claim 5, wherein the body has a cylindrical shape, the second scale is formed along a circular arc of a second end of the body opposite to the first end, and the second encoder head is positioned to sense the second scale.

7. The substrate aligning unit of claim 1, further comprising a tension sensing roll configured to contact the substrate and sense a tension of the substrate to generate a tension signal.

8. The substrate aligning unit of claim 7, wherein the controller increases a rotation speed of the second driving roll or decreases a rotation speed of the first driving roll in response to the tension signal being lower than a threshold, and wherein the controller decreases a rotation speed of the second driving roll or increases a rotation speed of the first driving roll in response to the tension signal being higher than the threshold.

9. The substrate aligning unit of claim 1, wherein the first driving roll comprises a first lower driving roll and a first upper driving roll, the first lower driving roll and the first upper driving roll being configured to sandwich the substrate, and wherein the second driving roll comprises a second lower driving roll and a second upper driving roll.

10. The substrate aligning unit of claim 1, further comprising a precise aligning part comprising:

a camera part to detect an aligning mark formed on the substrate; and a precise controller to control the position of the substrate to align the aligning mark according to a reference mark.

11. A substrate processing apparatus, comprising:

a substrate aligning unit comprising:

a first driving roll to transfer a substrate in a first direction;

a second driving roll spaced apart from the first driving roll and configured to transfer the substrate in the first direction;

an encoder roll to determine a position of the substrate to generate a sensing signal;

a web guider comprising a first web guider roll and a second web guider roll to adjust the position of the substrate in a cross machine direction parallel to a rotational axis of the encoder roll; and a controller to control the first driving roll, the second driving roll, and the positions of the first and second web guider rolls, based on the sensing signal; and a processing part coupled to the substrate aligning unit to process the substrate, wherein the encoder roll comprises:

a body;

an encoder to determine a first position of the substrate in the cross machine direction to generate the sensing signal, the encoder comprising:

a scale that moves corresponding to a movement of the substrate in the cross machine direction; and an encoder head configured to detect a movement of the scale and to generate the sensing signal, wherein the scale is formed on a protrusion disposed at an end of the body, and the encoder head is positioned to sense the scale.

12. The substrate processing apparatus of claim 11, wherein the processing part comprises more than one processing part and the substrate aligning unit comprises more than one substrate aligning unit, and wherein the first direction is perpendicular to the cross machine direction.

13. A method of aligning a substrate, the method comprising:

determining a position of the substrate using an encoder roll to generate a sensing signal according to the determined position;

controlling a first driving roll and a second driving roll to control transfer speed of a substrate in a first direction; and controlling a web guider comprising a first web guider roll and a second web guider roll configured to adjust the position of the substrate in a cross machine direction parallel to a rotational axis of the encoder roll, wherein the encoder roll comprises:

a body;

an encoder determining a first position of the substrate in the cross machine direction and generating the sensing signal, the encoder comprising:

a scale formed on a protrusion disposed at an end of the body, the scale moving corresponding to a movement of the substrate in the cross machine direction; and an encoder head positioned to sense the scale, the encoder head detecting a movement of the scale and generating the sensing signal.

14. The method of claim 13, further comprising sensing a tension of the substrate to generate a tension signal, and wherein controlling the first driving roll, the second driving roll, and the web guider further comprises controlling a speed of the first driving roll and a speed of the second driving roll to adjust the tension of the substrate to a threshold value based on the tension signal.

15. The method of claim 13, further comprising precisely aligning the substrate using an aligning mark formed on the substrate, and wherein precisely aligning the substrate comprises:

detecting an aligning mark formed on the substrate; and controlling the position of the substrate to align the aligning mark with a reference mark.

16. The method of claim 15, wherein the position of the substrate is determined periodically.

* * * * *